US007877885B2

(12) United States Patent
Davis

(10) Patent No.: US 7,877,885 B2
(45) Date of Patent: Feb. 1, 2011

(54) RANGE FINDER FOR AN ARCHERY BOW

(76) Inventor: Lewis E. Davis, 6151 Allen Dr., Conroe, TX (US) 77304

( * ) Notice: Subject to any disclaimer, the term of this patent is extended or adjusted under 35 U.S.C. 154(b) by 0 days.

(21) Appl. No.: 12/694,408

(22) Filed: Jan. 27, 2010

(65) Prior Publication Data

US 2010/0122467 A1 May 20, 2010

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS 2,574,599 A 11/1951 Stieber
2,767,472 A 10/1956 Kocur
3,234,651 A * 2/1966 Rivers ..... 33/265
3,308,540 A * 3/1967 Dean ..... 33/262
3,365,800 A 1/1968 Carella
3,455,027 A 7/1969 Perkins
3,696,517 A 10/1972 Larson
3,811,195 A * 5/1974 Carella ..... 33/265
4,244,115 A * 1/1981 Waldorf ..... 33/265

* cited by examiner

*Primary Examiner*—Yaritza Guadalupe-McCall
(74) *Attorney, Agent, or Firm*—Claude E. Coone, Jr.; John J. Love; Burleson Cooke L.L.P.

(57) ABSTRACT

A range finder that is particularly adapted for use in conjunction with an archery bow has a generally L-shaped configuration one end of which is threaded for attachment to a socket normally provided on archery bows. Another portion of the range finder includes a plurality of disks that are adjustably positioned on a support member so that the range finder can be individually calibrated for specific game also taking into account the physical characteristics of the hunter.

5 Claims, 1 Drawing Sheet

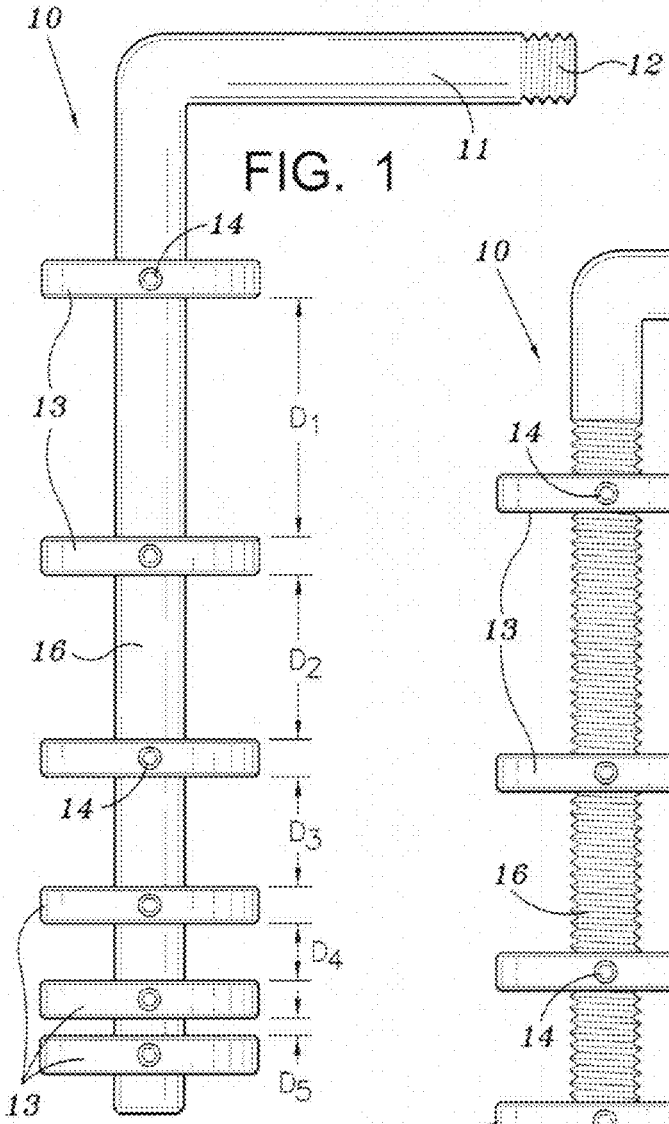
FIG. 1
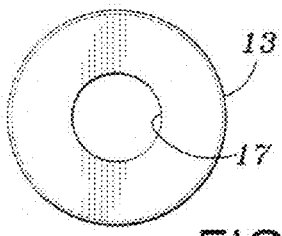
FIG. 2
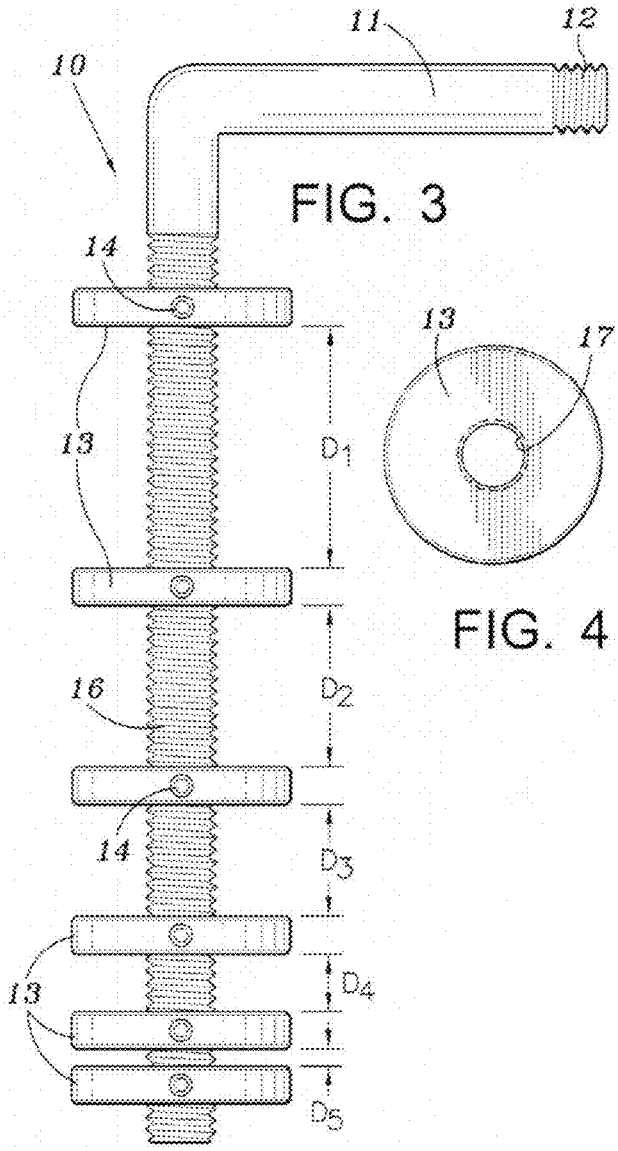
FIG. 3
FIG. 4

RANGE FINDER FOR AN ARCHERY BOW

BACKGROUND OF INVENTION

1. Field of the Invention

This disclosure is directed to a range finder for determining distances from one point to another and is particularly suitable for use in combination with an archery bow to allow a hunter to determine the distance from the hunter to the target.

2. Description of Related Art

Several range finders have been developed for use in determining distances in conjunction with hunting using an archery bow. Examples of static devices that do not utilize electronic components are found in U.S. Pat. Nos. 3,696,517; 3,455,027; 3,365,800; 2,767,472; and 2,574,599. These devices are not designed for use with modern archery equipment and do not allow for adjustability so that they can be used to determine the distance for multiple types of game.

BRIEF SUMMARY OF THE INVENTION

The present invention overcomes the difficulties of the prior art by providing a simple and effective mechanism for attachment to modern archery bows and also includes an adjustment mechanism so that the device can be used for estimating distances for different game and can be calibrated to account for the differences in the arm length of hunters. The range finder includes an L-shaped member that is threaded at an end. Most modern day archery bows are equipped with an internally threaded socket for receiving accessories. Thus the threaded portion of the L-shaped member according to the invention can be secured to the bow by threading it into the socket already provided on the bow. The other portion of the L-shaped member is provided with a plurality of disk like members having a central aperture for a sliding fit over the member. As will be explained below, this allows the user to calibrate the range finder for a particular type of game and to take into account the physical dimension of the hunter.

BRIEF DESCRIPTION OF THE SEVERAL VIEWS OF THE DRAWING(S)

FIG. 1 is a side view of the range finder according to an embodiment of the invention.

FIG. 2 is a top view of one of the disks according to an embodiment of the invention FIG. 3 is a side view of a second embodiment of the invention FIG. 4 is a top view of one of the disks according to a second embodiment of the invention.

DETAILED DESCRIPTION OF THE INVENTION

As shown in FIG. 1, the range finder 10 of the present invention includes a generally L-shaped member having a first generally horizontal portion 11 and a second generally vertical portion 16. The member may be of any cross section configuration such as circular, rectangular, square, or oval, and may be tubular or consist of a solid piece of stock material, such as aluminum. Also provided is a plurality of disk members 13 having a central opening 17 that closely matches the configuration of the outer surface of member 16. As shown in FIG. 2 the opening is circular, however other shapes are contemplated to fall within the scope of the invention. The shape of the opening 17 is selected to correspond to the shape of the L-shaped member portion 16.

Each disk is provided with a securing device 14 for adjustably securing the disk to member 16. The securing device could be a set screw, ball detent, or any other type of known securing device. The disks may be circular, square, rectangular, oval or any other shape.

FIG. 3 illustrates an embodiment wherein the exterior surface of member 16 is treaded to adjustably receive disks 13 that have a centrally threaded aperture 17. These disks may also be equipped with additional securing means such as a set screw as shown at 14.

In use, the range finder is calibrated in the following manner. The device needs to be calibrated to take into account the game being hunted and the physical dimensions of the hunter. First, the ideal target "sweet spot" for the particular game is selected. For example, for deer hunting the target area for the deer is between the lower belly and the upper portion of the back, approximately 18" for a mature male deer. A rectangular template with a height of 18 inches is constructed and placed ten yards from the shooting point at a height corresponding to that of a mature deer. The hunter, with the range finder attached to the bow, positions the upper two disks at the top and bottom of the template with the bow extended in a shooting position. Thus, in use, a deer whose target area or "sweet spot" corresponds to D1 is approximately 10 yards from the shooter. The hunter would then use the sight pin that corresponds to ten yards. The same procedure is repeated for D3, D2, etc at selected yardage, for example twenty, thirty yards, etc. Thus if the sweet spot of the deer is framed by the gap D2, the deer is 20 yards away and the sight pin corresponding to 20 yards is selected. The device can be calibrated in this manner for any distance intervals. For example, five, ten, fifteen, twenty, etc if desired and more disks can be provided.

When hunting for a different game, elk for example, the target area or "sweet spot" for elk, which may be 28 inches, is used for the template instead of 18 inches and the process is repeated. In this fashion, multiple range finders can be calibrated for specific game or the hunter may recalibrate a given range finder for the intended game. This process also takes into account that the distance between a hunters eye and their extended arm varies from hunter to hunter.

Although the present invention has been described with respect to specific details, it is not intended that such details should be regarded as limitations on the scope of the invention, except to the extent that they are included in the accompanying claims.

I claim:

1. A range finder for use with an archery bow consisting of:

an elongated generally L-shaped member having a first portion that extends in a generally horizontal direction when in use and a second portion that extends in a generally vertical direction when in use;

a means for connecting one end of the first portion of the L-shaped member to a socket provided on the archery bow;

a plurality of disk member having central apertures and slidably and adjustably positioned on the second portion of the L-shaped member, the second portion of the L-shaped member passing through the central apertures in the disks; and means for adjustably fixing the position of the disks on the second portion of the L-shaped member.

2. The range finder of claim 1 wherein the means for connecting the one end of the first portion of the L-shaped member to a socket provided on the archery bow comprises screw threads on an end of the first portion.

3. The range finder of claim 1 wherein the means for adjustably fixing the position of the disks on the second portion of the L-shaped member comprises a set screw extending from an exterior surface of each disk to a position within the central aperture.

4. The range finder of claim 1 wherein the second portion of the L-shaped member includes screw threads on an outer surface thereof and, the disks have screw threads located within the central aperture so that the disks can be threaded onto the second portion of the L-shaped member and positioned in selected locations along the second portion.

5. A range finder for use with an archery bow consisting of:

an elongated generally L-shaped member having a first portion that extends in a generally horizontal direction when in use and a second portion that extends in a generally vertical direction when in use;

a means for connecting one end of the first portion of the L-shaped member to a socket provided on the archery bow; and a plurality of disk members positioned on the second portion of the L-shaped member.

* * * * *